US008021184B1

(12) United States Patent
Patten, Jr.

(10) Patent No.: US 8,021,184 B1
(45) Date of Patent: Sep. 20, 2011

(54) CONNECTOR APPARATUS FOR JOINING A LUG WITH A CONDUCTOR

(76) Inventor: Joseph W. Patten, Jr., Odessa, FL (US)

( * ) Notice: Subject to any disclaimer, the term of this patent is extended or adjusted under 35 U.S.C. 154(b) by 0 days.

(21) Appl. No.: 12/719,470

(22) Filed: Mar. 8, 2010

(51) Int. Cl.
*H01R 4/24* (2006.01)

(52) U.S. Cl. ..... 439/428; 439/805

(58) Field of Classification Search ..... 439/427, 439/428, 462, 778, 779, 801, 805
See application file for complete search history.

(56) References Cited

U.S. PATENT DOCUMENTS

| | | | | |
|---|---|---|---|---|
| 2,279,508 | A * | 4/1942 | Bergan | 439/805 |
| 3,205,472 | A * | 9/1965 | Shannon | 439/764 |
| 3,790,920 | A * | 2/1974 | Wening | 439/522 |
| 4,141,619 | A | 2/1979 | DeLuca | |
| 5,100,348 | A * | 3/1992 | Herman et al. | 439/724 |
| 5,362,253 | A | 11/1994 | Lin et al. | |
| 5,573,423 | A | 11/1996 | Lin et al. | |
| 6,851,966 | B1 * | 2/2005 | Tomasino | 439/411 |
| 6,857,895 | B2 * | 2/2005 | Korte et al. | 439/428 |
| 7,112,106 | B1 * | 9/2006 | Su | 439/805 |
| 7,121,872 | B1 * | 10/2006 | Hanks | 439/427 |
| 7,399,194 | B1 * | 7/2008 | Gilliam | 439/263 |
| 7,699,645 | B1 * | 4/2010 | Montena et al. | 439/427 |

* cited by examiner

*Primary Examiner* — Thanh Tam Le
(74) *Attorney, Agent, or Firm* — Anton J. Hopen; Jeremy D. Spier; Smith & Hopen, P.A.

(57) ABSTRACT

A system for joining a lug with a conductor includes a lug, compression nut, and conductor. The lug has material removed to allow for compression, an internal hole sized slightly larger than the conductor, and a tapered end. The compression nut has an internal thread and tapered end to match the lug. When assembled, the conductor is compressed against the lug creating a strong mechanical and electrical contact. The tighter the lug is screwed, the greater the compression between the lug and conductor.

5 Claims, 7 Drawing Sheets

CONNECTOR APPARATUS FOR JOINING A LUG WITH A CONDUCTOR

BACKGROUND OF THE INVENTION

1. Field of the Invention

This invention relates to a novel system for joining a lug with a conductor. More specifically, this invention relates to a novel system that compresses a lug around a conductor to create an improved mechanical and electrical connection.

2. Description of the Prior Art

As described in U.S. Pat. Nos. 4,146,290, 2,920,305, 5,957,733, systems for connecting lugs with conductors are well known in the art. Conventional lugs typically include a body portion provided with an opening into which the conductor (i.e., bare wire) is inserted. The conductor may be retained in the lug opening by crimping, or alternatively by means of securing bolts. The traditional means of crimping or bolting the conductor within the lug opening, however, does not provide for a secure mechanical connection and similarly provides a poor electrical connection. The only contact points between the lug and conductor are the crimped sides of the lug opening or the distal end of the securing bolts. Both methods provide insufficient contact surface connection. Furthermore, the crimped connection requires the need for expensive tools.

What is needed is a system for joining a lug with a conductor that provides an improved mechanical and electrical connection. What is also needed is a device that provides a mechanically and electrically sound connection without the need or use of expensive tools.

However, in view of the prior art considered as a whole at the time the present invention was made, it was not obvious to those of ordinary skill in the art how the limitations of the art could be overcome.

SUMMARY OF INVENTION

The long-standing but heretofore unfulfilled need for an improved system for joining a lug with a conductor is now met by a new, useful, and nonobvious invention.

The invention comprises a lug, compression nut, and a conductor. The lug threads have material removed to allow for compression, an internal hole sized slightly larger than a conductor, and a tapered end. The compression nut has female threads and a tapered end to match the lug.

When the device is assembled, the conductor is passed through the compression nut and positioned within the internal hole of the lug threads. Due to the internal tapered wall of the compression nut, as the lug is screwed into the compression nut, the conductor is compressed against the lug. To allow for greater compression as the lug is threaded down the taper of the compression nut, the compression grooves (i.e., the material removed to allow for compression) compress and allow the lug to be further tightened. The tighter the lug is screwed, the greater the compression between the lug and conductor.

The internal hole of the lug threads has internal ribs or threads for penetrating the conductor during tightening.

The lug and compression nut have a hex or external feature for tightening.

It is an object of the claimed invention to provide a strong mechanical and electrical contact between a lug and conductor.

A further objective of the claimed invention is to provide a system for creating a strong mechanical and electrical contact between a lug and conductor that is easy to use, intuitive to use, cheap to manufacture, and does not require the use of expensive tools.

BRIEF DESCRIPTION OF THE DRAWINGS

For a fuller understanding of the invention, reference should be made to the following detailed description, taken in connection with the accompanying drawings, in which:

FIG. 1(*b*) is an upper exploded perspective view;

FIG. 2(*b*) is an upper exploded perspective view of the alternative embodiment of the invention;

FIG. 3(*b*) is a lower perspective view of the lug;

FIG. 3(*c*) is a cross-sectional view of the lug;

FIG. 4(*b*) is a lower perspective view of the lug of the alternative embodiment of the invention;

FIG. 4(*c*) is a cross-sectional view of the lug of the alternative embodiment of the invention;

FIG. 5(*b*) is an upper perspective view of the lug and compression nut;

FIG. 6(*b*) is an upper perspective view of the lug and compression nut of the alternative embodiment of the invention.

FIG. 7(*b*) is an upper perspective view of the assembled system of the alternative embodiment of the invention.

DETAILED DESCRIPTION OF THE PREFERRED EMBODIMENT

The system for joining a lug with a conductor is generally shown as element 10.

Figure 1:
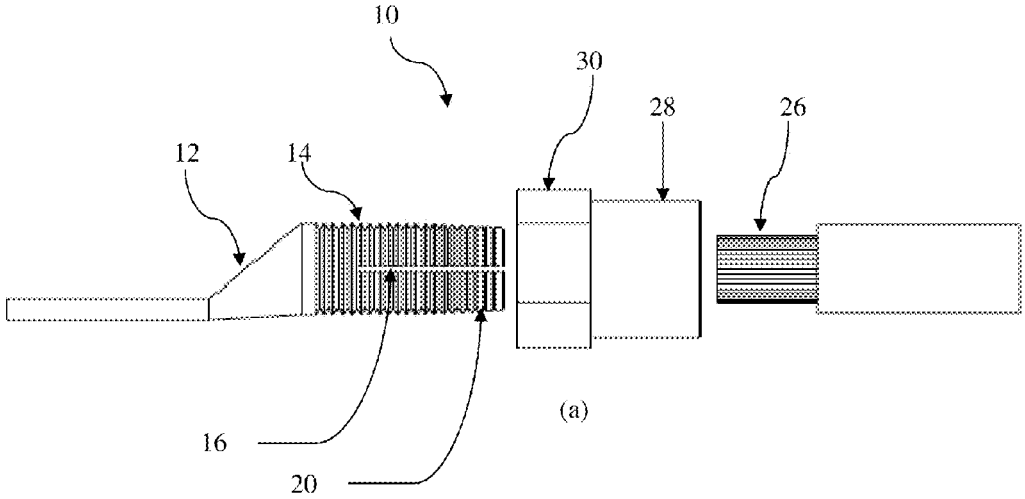
FIG. 1(*a*) is an exploded side view.
Figure 1:
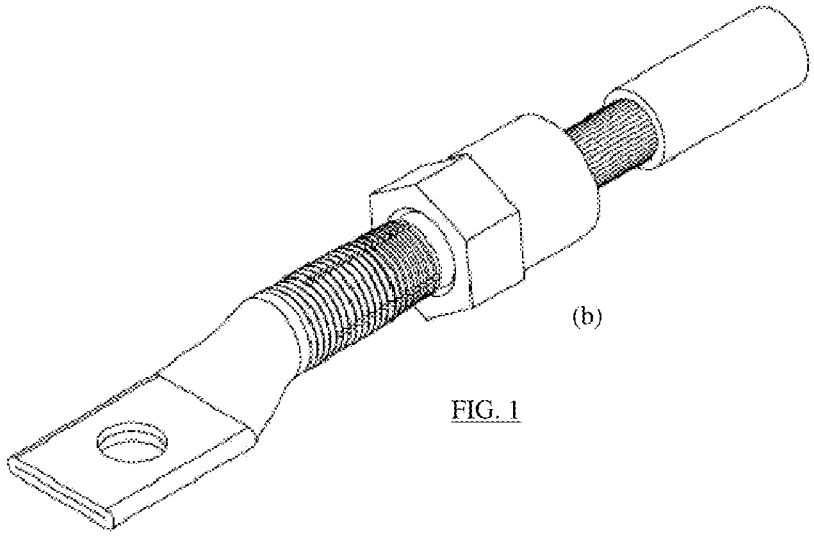
Figure 2:
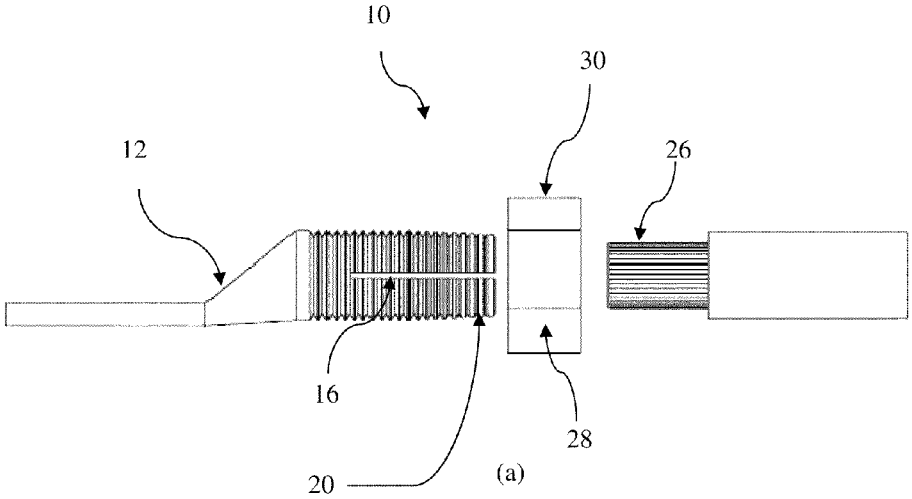
FIG. 2(*a*) is an exploded side view of an alternative embodiment of the invention.
Figure 2:
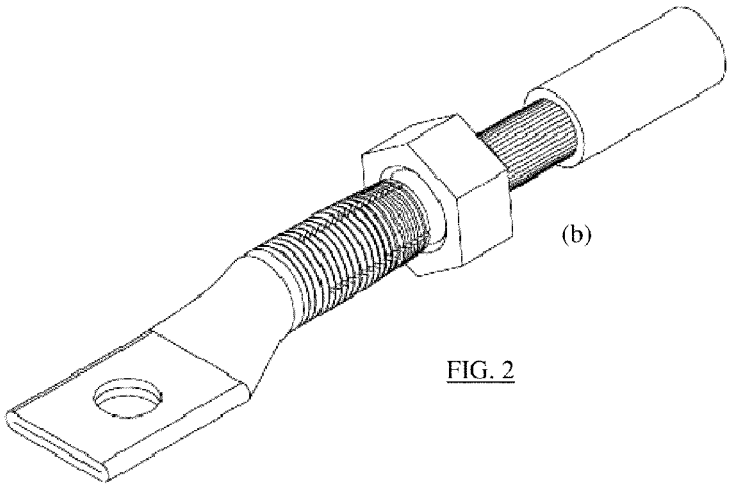
Figure 5:
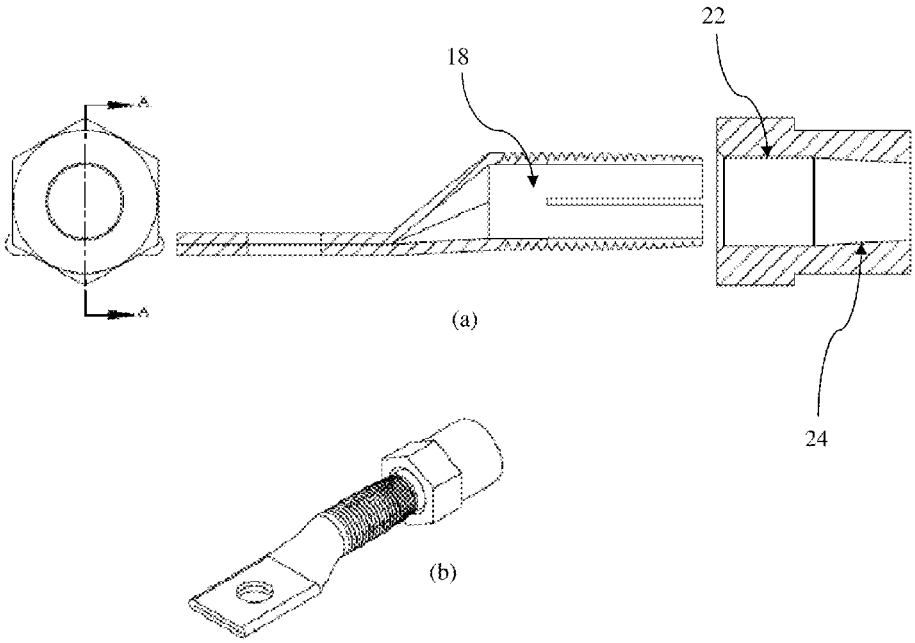
FIG. 5(*a*) is a cross-sectional view of the lug and compression nut.

As shown in FIGS. 1 and 5, lug 12 includes male threads 14, compression grooves 16, internal hole 18, and tapered end 20. The compression nut includes female threads 22, hex fastener 30, and internal taper 24. Internal hole 18 is sized slightly larger than conductor 26 to facilitate insertion of conductor 26 into internal hole 18. The threaded end of lug 12 includes tapered end 20 to facilitate the initial insertion of male threads 14 into internal taper 24.

When assembled, conductor 26 is passed through compression nut 28 and positioned within internal hole 18 of male threads 14. As lug 12 and compression nut 28 are screwed together, conductor 26 is compressed against lug 12. As lug 12 is threaded down internal taper 24, compression grooves 16 compress. The tighter lug 12 and compression nut 28 are screwed together, the greater the compression between lug 12 and conductor 26.

Figure 4:
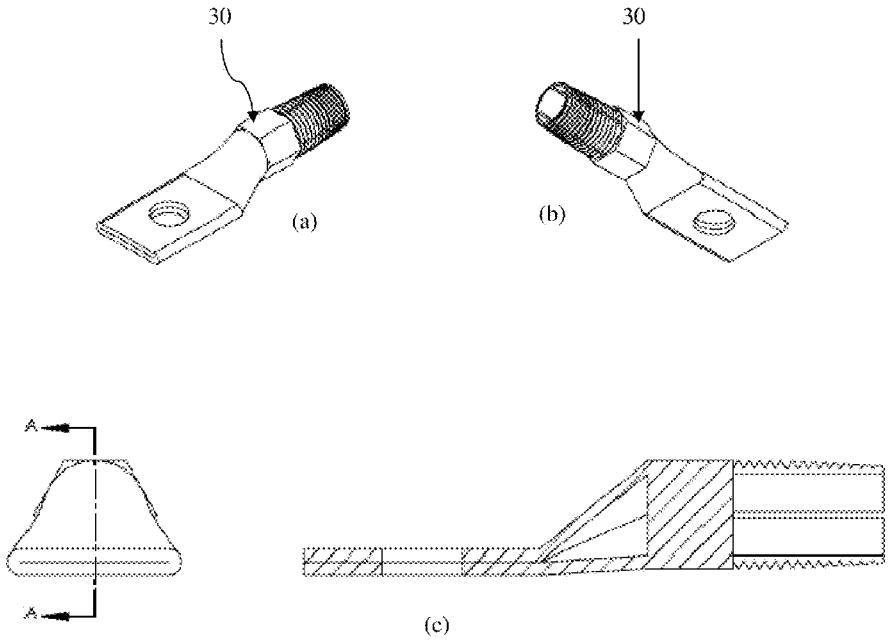
FIG. 4(*a*) is an upper perspective view of the lug of the alternative embodiment of the invention.
Figure 6:
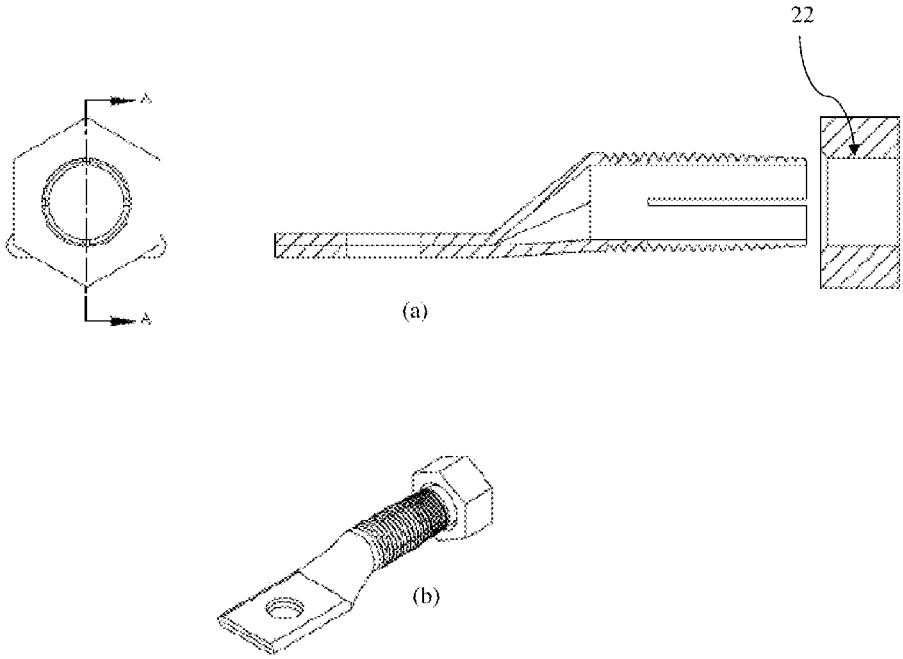
FIG. 6(*a*) is a cross-sectional view of the lug compression nut of the alternative embodiment of the invention.
Figure 7:
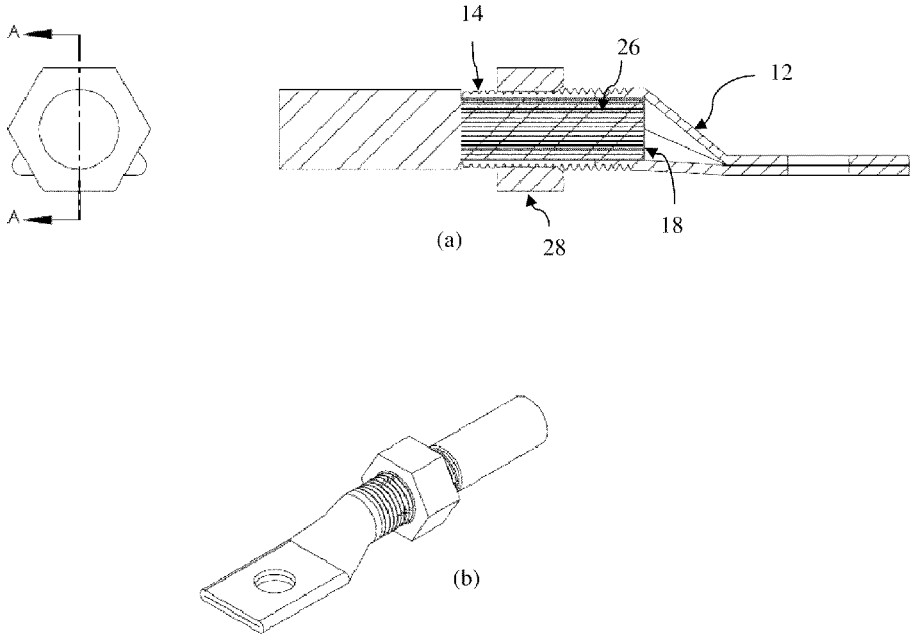
FIG. 7(*a*) is a cross-sectional view of the assembled system of the alternative embodiment of the invention.

In an alternate embodiment, as shown in FIGS. 4, 6 and 7, compression nut 28 does not have an internal taper. Instead, only lug 12 is tapered. As lug 12 and compression nut 28 are screwed together, conductor 26 is compressed against lug 12.

The device may include one or more compression grooves. As shown in FIG. 1, compression grooves 16 may be parallel to the longitudinal axis of lug 12. Compression grooves 16 provide space for lug 12 to compress around conductor 26 as male threads 14 are threaded into internal taper 24.

Figure 3:
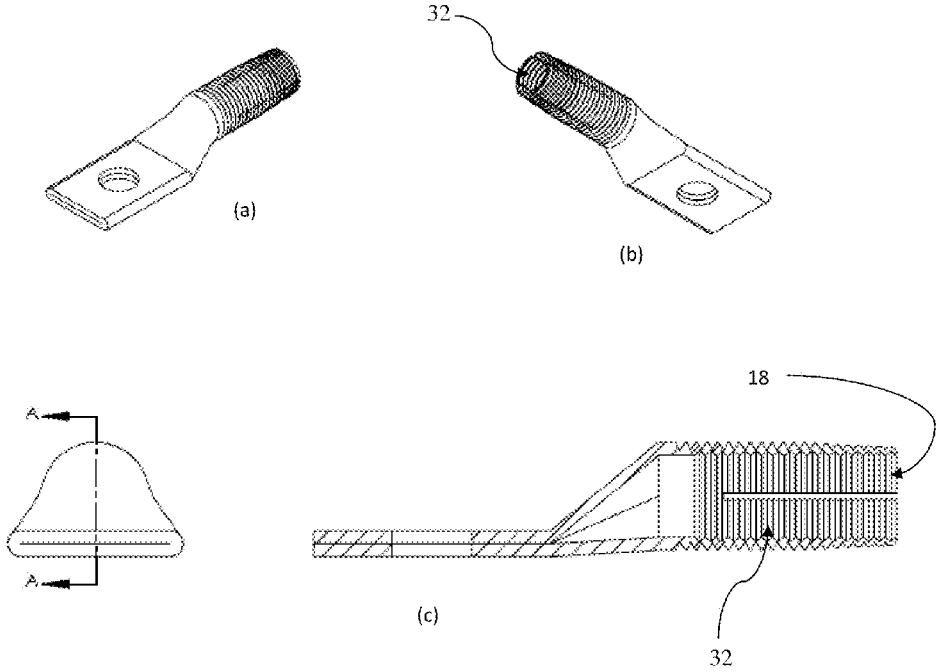
FIG. 3(*a*) is an upper perspective view of the lug.

As shown in FIG. 3, internal hole 18 of lug 12 may include internal ribs 32.

Internal ribs 32 are positioned along the internal surface of internal hole 18 and penetrate conductor 26 when lug 12 is compressed around conductor 26. The penetration of internal ribs 32 into conductor 26 provides for a greater mechanical and electrical contact. Internal ribs 32 may be annular (as shown) or longitudinal (not shown).

In an embodiment, internal taper 24 and tapered end 20 have matching angles to further facilitate the initial insertion of male threads 14 into internal taper 24.

As shown in FIGS. 1, 2, 4, 5, and 6, both compression nut 28 and lug 12 have standard hexes 30 for wrenches to grasp when assembling and tightening device 10.

The assembled system is depicted in FIG. 7. Conductor 26 is inserted into internal hole 18 within male threads 14 of lug 12. Conductor 26 is compressed directly against lug 12 as compression nut 28 is tightened around lug 12.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A system for joining a lug with a conductor, comprising:

a lug, said lug having male threads, said male threads of said lug having a tapered end, said lug having an internal hole within said male threads sized slightly larger than said conductor, said male threads having at least one compression groove; and a compression nut, said compression nut having female threads matching said male threads of said lug, said compression nut having an internal taper, said internal taper of said compression nut and said tapered end of said male threads of said lug having a matching angle, wherein said conductor is inserted into said internal hole within said male threads of said lug and compressed directly against said lug as said compression nut is tightened around said lug.

2. A system for joining a lug with a conductor as in claim 1, further comprising:

said at least one compression groove being parallel to a longitudinal axis of said male threads of said lug.

3. A system for joining a lug with a conductor as in claim 1, further comprising:

said internal hole of said male threads of said lug having ribs.

4. A system for joining a lug with a conductor as in claim 1, further comprising:

said lug having a means for grasping and tightening.

5. A system for joining a lug with a conductor as in claim 1, further comprising:

said compression nut having a means for grasping and tightening.

* * * * *